US006694788B1

(12) United States Patent
Hsieh

(10) Patent No.: US 6,694,788 B1
(45) Date of Patent: Feb. 24, 2004

(54) LOCK CORE WITH A RELATED KEY

(76) Inventor: Hui-Hua Hsieh, P.O. Box 90, Tainan City (TW)

( * ) Notice: Subject to any disclaimer, the term of this patent is extended or adjusted under 35 U.S.C. 154(b) by 0 days.

(21) Appl. No.: 10/369,693

(22) Filed: Feb. 21, 2003

(51) Int. Cl.[7] ..... E05B 27/00
(52) U.S. Cl. ..... 70/491; 70/388
(58) Field of Search ..... 70/491, 388, 389, 70/453–455, 423, 427, 428

(56) References Cited

U.S. PATENT DOCUMENTS 3,524,335 A * 8/1970 George ..... 70/491
3,661,001 A * 5/1972 Glass ..... 70/388
3,894,416 A * 7/1975 Castle ..... 70/428 X
3,961,507 A * 6/1976 Falk ..... 70/491 X
3,971,242 A * 7/1976 Mikos ..... 70/388
3,995,463 A * 12/1976 Mikos ..... 70/388
4,104,897 A * 8/1978 Freedman ..... 70/491 X
4,104,898 A * 8/1978 Fois ..... 70/423 X
4,967,578 A * 11/1990 Sheu et al. ..... 70/491
5,163,310 A * 11/1992 Wang ..... 70/491
5,447,049 A * 9/1995 Shieh ..... 70/491 X
5,913,907 A * 6/1999 Lee ..... 70/491 X
6,494,068 B2 * 12/2002 Lee ..... 70/491 X

* cited by examiner

*Primary Examiner*—Suzanne Dino Barrett

(57) ABSTRACT

A lock core with a related key includes a core body and a housing and a related key. The related key is inserted in a keyhole of the core body and pushed inward to push a stop plate inward in the keyhole at the same time, with projecting ridges of the key moving inward together with engage shafts until projecting members align with an annular groove of the housing. Then the core body can be rotated to be unlocked. When the key is pulled out of the core body, the engage shafts and the stop plate return to their original positions by the springs to lock the core body. Thus the stop plate normally closes up the keyhole, preventing dirt and miscellaneous matters from entering the keyhole. Any matters or even broken key parts may be sprung out of the keyhole by the stop plate, with the keyhole never clogged.

2 Claims, 2 Drawing Sheets

LOCK CORE WITH A RELATED KEY

BACKGROUND OF THE INVENTION

1. Field of the Invention

This invention relates to a lock core with a related key, particularly to one with a keyhole normally closed up by a stop plate to keep dirt or miscellaneous matters from entering the core body through the keyhole. In unlocking the lock core, the related key is inserted in the keyhole by pushing the stop piece inward to force projecting ridges on the surface of the key to push engage shafts inward at the same time until a projecting block aligns to an annular groove of a housing of the core. Then the key can rotate the core body to unlock the lock core. When the key is pulled out of the core body, the engage shafts and the stop piece return to their position by function of springs to lock the lock core. Even in case of the key broken and having parts remained in the keyhole, the parts can be sprung out of the keyhole by the stop plate, not clogging the keyhole.

2. Description of the Prior Art

Common locks generally have their keyholes normally not closed up so that dirt or miscellaneous matters may enter in the keyhole to clog them to cause a key unable to enter the keyhole or pulled out. Then it has to be cleaned or repaired to result in some trouble.

SUMMARY OF THE INVENTION

This invention has been devised to offer a lock core with a related key having the keyhole normally closed up to prevent dirt or miscellaneous matters from entering and clogging the keyhole.

One feature of the invention is a core body provided with slide grooves, and a housing provided with long grooves to correspond to the longwise slide grooves of the core body, a lateral annular groove formed in an inner wall of the housing, an engage shaft of a torque spring placed in each slide groove, a projection formed on each engage shaft to protrude in each long groove of the housing, and a stop plate with a stud in front of the keyhole, a stop-plate hole formed in the core body, and a small spring fitted in the stop-plate hole for normally closing the keyhole.

Another feature of the invention is the shape and the size of the related key made to match with the keyhole of the core, having lengthwise projecting ridges in accordance with the long grooves of the inner wall of the housing. The front ends of the projecting ridges are different from one another.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
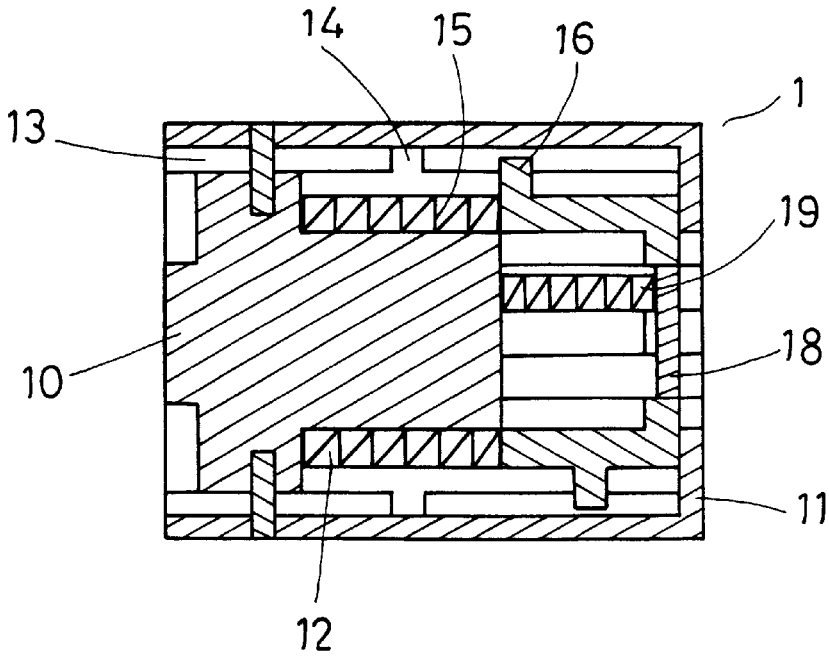
FIG. 1 is a cross-sectional view of a lock core in the present invention, showing a stop plate closing up a keyhole of the core body.
Figure 2:
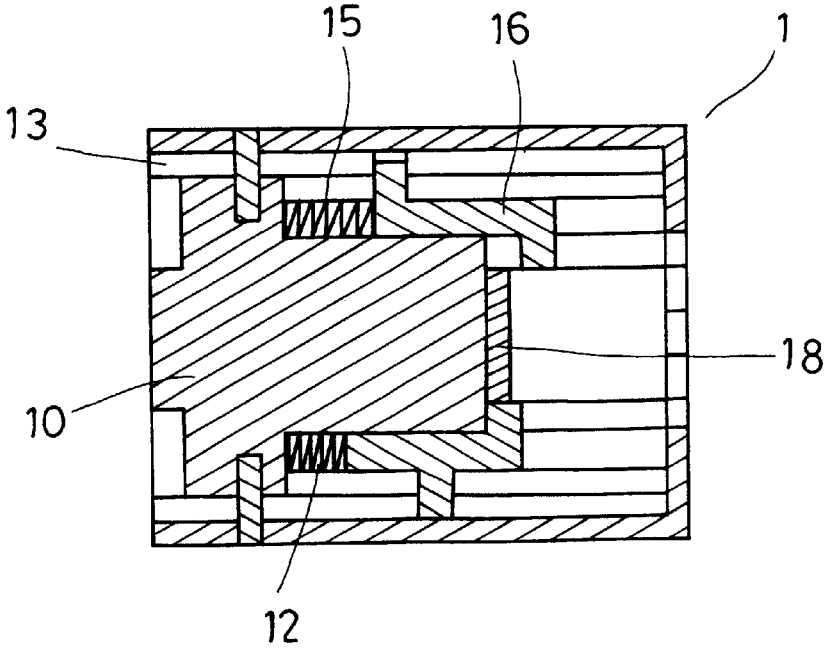
FIG. 2 is a cross-sectional view of the lock core in the present invention, showing the stop plate not closing up the keyhole.
Figure 3:
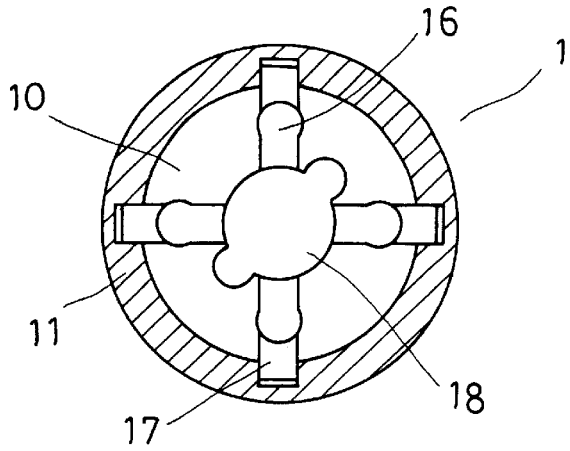
FIG. 3 is a front cross-sectional view of the lock core in the present invention.

A preferred embodiment of a lock core with a related key in the present invention, as shown in FIGS. 1, 2 and 3, includes a lock core 1 consisting of a core body 10 and a housing 11 receiving and letting the core body 10 rotate therein, and a related key 2 for locking and unlocking the lock core 1.

The core body 10 has a plurality of lengthwise slide grooves 12 formed spaced apart in an annular surface, and the housing 11 has an inner wall formed spaced apart with the same number of long grooves 13 as those of the lengthwise grooves 12 to correspond with each other, a lateral annular groove 14 in the inner wall. Further, an engage shaft 16 and a spring 15 contacting the inner end of the engage shaft 16 are provided in each slide groove 12. The engage shaft 16 has a protruding member 17 fitting in each of the long grooves 13, a stop plate 18 with a stud fitting movable in a stop-plate hole 19 of the core body 10 also with a small spring fitted therein, forming a sealing structure of the keyhole.

Figure 4:
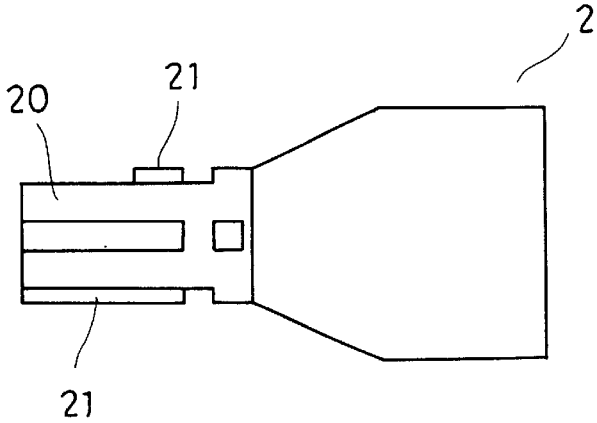
FIG. 4 is a side view of a related key of the lock core in the present invention; and, FIG. 5 is a front view of the related key of the lock core in the present invention.
Figure 5:
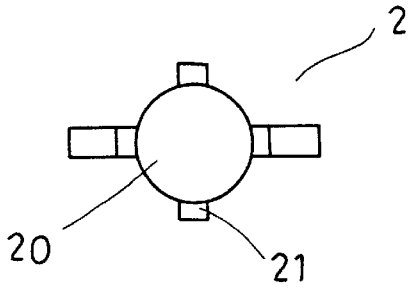

The FIGS. 4 and 5 show the related key 2, which has the shape and the size as the keyhole of the core body 10, having the same number of lengthwise ridges 21 as those of the long grooves 13 of the housing 11. The projecting ridges 21 have their front ends located differently from each other, corresponding to the engage shafts 16.

In using the lock core with the related key, referring to FIGS. 1–5, insert the key 2 in the keyhole of the core body 10, pushing the stop plate 18 inward, with the projecting ridges 21 pushing the engage shafts 16 inward at the same time until the projecting members 17 of the engage shafts 16 align with the annular groove 14 of the housing 11. Then at this position, the core body 10 is possible to be rotated by the key 2 to be unlocked.

When the key 2 is pulled out of the core body 10, the stop plate 18 and the engage shafts 16 return to the original position by means of the springs 15 recovering its elasticity so far compressed by the projecting ridges 21, with the core body 10 positioned in the locked condition.

Thus, the keyhole of the core body 10 is normally closed up by the stop plate 18, preventing dirt and miscellaneous matters from entering the keyhole of the core body 10, and protecting the core 1 safely. Even should the related key be broken and a part of the key remain in the keyhole, it would be sprung out of the keyhole by means of the stop plate 18 pushed by the springs 15, not clogging the keyhole at all.

While the preferred embodiment of the invention has been described above, it will be recognized and understood that various modifications may be made therein and the appended claims are intended to cover all such modifications that may fall within the spirit and scope of the invention.

What is claimed is:

1. A lock core with a related key comprising a core lock consisting of a core body and a housing receiving and permitting said core body to rotate therein, and a related key; and, characterized by said core body having a plurality of lengthwise slide grooves formed spaced apart on a surface of said core body, said housing having in its inner wall the same number of lengthwise long grooves corresponding to said slide grooves of said core body, said housing further having a lateral annular groove in an inner wall of said housing, an engage shaft with a spring contacting an inner end of said engage shaft fitted in each said lengthwise slide groove of said core body, each said engage shaft having a projecting member, a stop plate with a stud provided to fit movably in said keyhole of said core body, said core body having a stop-plate hole for containing a small spring and said stud of said stop plate therein so as to form a keyhole closing structure;

said key inserted in said keyhole of said core body and pushed inward to push inward said stop plate at the same time with said engage shafts pushed by projecting ridges of said key until said projecting members of said engage shafts move and align with said annular groove of said housing so that said core body may be rotated by said key to be unlocked, said core body locked in case said key pulled out of said keyhole and said engage shafts and said stop plate returning to original positions not be pushed by means of said springs to lock said core body, said stop plate normally closing up said keyhole of said core body and preventing dirt and miscellaneous matters from entering said keyhole, said stop plate removing any matters or broken key parts from said keyhole if said key should break.

2. The lock core with a related key as claimed in claim 1, wherein said key has the same number of lengthwise ridges on a surface of said key as said lengthwise long grooves of said housing to match each other, said projecting ridges having a front end differently located from each other and respectively corresponding to said engage shafts.

* * * * *